US007192182B2

(12) United States Patent
Hiranuma et al.

(10) Patent No.: US 7,192,182 B2
(45) Date of Patent: Mar. 20, 2007

(54) WINDING STEM PIPE WITH FRICTION RING

(75) Inventors: Haruki Hiranuma, Chiba (JP); Nobukazu Omori, Chiba (JP); Hisamitsu Yoshikawa, Chiba (JP)

(73) Assignee: Seiko Instruments Inc. (JP)

( * ) Notice: Subject to any disclaimer, the term of this patent is extended or adjusted under 35 U.S.C. 154(b) by 176 days.

(21) Appl. No.: 10/881,942

(22) Filed: Jun. 30, 2004

(65) Prior Publication Data

US 2005/0007891 A1 Jan. 13, 2005

(30) Foreign Application Priority Data

Jul. 7, 2003 (JP) ..... 2003-192593

(51) Int. Cl.
*G04B 37/00* (2006.01)

(52) U.S. Cl. ..... 368/289; 368/288; 368/308; 368/319

(58) Field of Classification Search ..... 368/319, 368/320, 321, 288, 289, 290, 190
See application file for complete search history.

(56) References Cited

U.S. PATENT DOCUMENTS 3,453,819 A * 7/1969 Simon ..... 368/290

FOREIGN PATENT DOCUMENTS

JP 57046181 3/1982

* cited by examiner

*Primary Examiner*—Vit Miska
*Assistant Examiner*—Sean Kayes
(74) *Attorney, Agent, or Firm*—Adams & Wilks

(57) ABSTRACT

To provide a portable timepiece in which the maintenance of a winding stem pipe and its surroundings is facilitated. Basically provided is a portable timepiece comprising a winding stem pipe releasably screwed into a pipe attachment opening of a case band, in which portable timepiece an accidental rotation of a crown is avoided by bringing a crown head of the crown into screw-engagement with a pipe end of the winding stem pipe disposed outside of the case band such that the crown head caps the pipe end. A ring receiver is formed on one of the pipe attachment opening and an insert portion of the winding stem pipe screwed into the opening. A soft and resilient friction ring is supported on the other of the pipe attachment opening and the insert portion. The friction ring is resiliently brought into tight contact with the ring receiver to prevent a rotation of the winding stem pipe. Thus, the portable timepiece of the invention is characterized in that an accidental rotation of the winding stem pipe which may be caused during operation of the crown is prevented, and that the winding stem pipe is releasable from the case band at the time of maintenance.

20 Claims, 7 Drawing Sheets

WINDING STEM PIPE WITH FRICTION RING

BACKGROUND OF THE INVENTION

1. Field of the Invention

The present invention relates to a portable timepiece having a structure for preventing an accidental rotation of a crown of the portable timepiece.

2. Description of the Prior Art

A conventional portable timepiece such as a diver's portable timepiece has a structure for locking a crown of the portable timepiece by means of screw-engagement, which is referred to as "screw-locking" or "screw-locking mechanism" in this specification, so as to prevent an accidental rotation of the crown while the portable timepiece is being carried with a user.

In the screw-locking structure, a winding stem pipe is attached to a case band containing a portable timepiece movement. A male screw is formed around the outer periphery of a pipe end of the winding stem pipe which pipe end projects outwardly from the case band. A female screw of a crown head to be fitted to the pipe end is brought into screw-engagement with the male screw. In a normal condition, the crown is allowed to be screw-locked by bringing the crown head into screw-engagement with the outer periphery of the pipe end of the winding stem pipe. For controlling the portable timepiece movement, the screw-engaged crown head is released from the male screw and the crown is pulled before a winding stem housed within the winding stem pipe is rotated.

In the conventional portable timepiece having this screw-locking structure, the attachment portion of the winding stem pipe is generally waterproofed by brazing the winding stem pipe to the case band (see JP-A-57-46181 (from page 1, right column line 8 to page 2, left column line 7, FIGS. 1 and 2), for example).

In another known portable timepiece having an additional male screw on a winding stem pipe apart from a male screw with which a crown screw-engages, the additional male screw is screwed into a pipe attachment opening of a case band, and along with the screwing action a waterproof packing is inserted between the case band and a crown head so as to waterproof the winding stem pipe attachment portion.

In a portable timepiece having a screw-locking mechanism, the screwlocking effect may be lowered by abrasion or wear between a female screw of a crown and a male screw of a winding stem pipe under the condition of a screw-engagement with each other as a result of impact caused by dropping or banging the timepiece, repetitive rotations of the crown or for other reasons.

When this situation occurs, the crown and its surroundings of the portable timepiece disclosed in JP-A-57-46181 cannot be replaced because the winding stem pipe which needs to be removed from the band case before the replacement is brazed to the case band. Thus, the entire portable timepiece casing assembly including the case band has to be replaced.

For a portable timepiece in which a winding stem pipe is screwed into a case band, theoretically the crown and its surroundings including a winding stem pipe are considered to be replaceable. In this structure, however, a rotational force is exerted on the winding stem pipe every time a crown is brought into screw-engagement with the winding stem pipe and released therefrom. This rotational force loosens the winding stem pipe screwed into the case band, resulting in possible lowering of waterproofing effect offered by a waterproof packing.

As a solution for this problem, such a method is sometimes adopted in which the screw-engagement portion between the winding stem pipe and the case band is filled with an adhesive. According to this adhesive method, it is in practice often difficult to remove the winding stem pipe from the case band since the applied amount of the adhesive is hard to be controlled. As a result, the crown and the surrounding components cannot be replaced and thus the entire portable timepiece casing assembly including the case band must be replaced when the screw-locking effect is lowered.

An object to be achieved by the present invention is to provide a portable timepiece whose crown and surrounding components are replaceable when a screw-locking function is lowered.

SUMMARY OF THE INVENTION

In order to solve the above problems, a structure according to the present invention comprises a case band which is provided with a pipe attachment opening having a female screw; a winding stem pipe including an insert portion provided with a first male screw which is releasably screwed into the female screw and a pipe end provided with a second male screw and disposed outside of the case band, the insert portion being screwed into the pipe attachment opening to be fitted to the case band; a crown having a crown head provided with a female screw which releasably screw-engages with the second male screw to be fitted to the winding stem pipe; and a friction ring which is supported on one of the pipe attachment opening and the insert portion and which is soft and resilient so as to be resiliently brought into tight contact with a ring receiver formed on the other of the pipe attachment opening and the insert portion for the prevention of a rotation of the winding stem pipe.

According to the present invention, the case band and the winding stem pipe can be suitably formed from metal such as stainless steel. However, the material for these components are not limited to metal but may be made from synthetic resin. In the invention, the friction ring can be supported on the insert portion and in this case the ring receiver is defined on the pipe attachment opening. Reversely, the friction ring can be supported on the pipe attachment opening and in this case the ring receiver is formed on the outer periphery of the insert portion. According to the invention, the material to be used for the friction ring may be natural rubber, synthetic rubber or synthetic resin. Synthetic resin such as polypropylene among these materials is especially preferable in its high resistance to degradation due to moisture, ozone or other factors and high weatherability. In the invention, it is desirable to form the friction ring from a single material since shaping of the friction ring is facilitated and the manufacturing cost is reduced. However, it is possible to form the friction ring from composite materials by a method such as laminating a plurality of materials each having different strength and elasticity. Alternatively, the friction ring may contain an elastically deformable ring-shaped metal wire or the like for reinforcement or other purpose if the portion of the friction ring contacting with the ring receiver and the insert portion is at least a soft and resilient layer.

According to the invention, the friction ring is compressedly interposed between the pipe attachment opening of the case band and the insert portion of the winding stem pipe screwed into the pipe attachment opening. The friction ring is resiliently brought into tight contact with the insert portion and the ring receiver so as to prevent the rotation of the winding stem pipe with respect to the case band by the frictional force caused by the contact. Thus, the rotation of the winding stem pipe which may be caused when the crown is operated or by other cause can be avoided without the necessity for bonding the winding stem pipe to the case band with an adhesive. Moreover, the winding stem pipe can be taken out from the case band by rotating the pipe in a loosening direction with a force larger than the frictional force of the friction ring. Accordingly, the components such as winding stem pipe can be replaced without the need for replacing the entire portable timepiece casing.

According to a preferred example of the present invention, the ring receiver and the friction ring are disposed closer to a band case inner space of the case band than a screw-engagement portion between the female screw of the case band and the first male screw is located. Thus, the exposure of the friction ring to ozone or moisture is avoided by the screw-engagement portion.

According to a preferred example of the present invention, the friction ring is supported such that the inner periphery of the friction ring engages with an annular groove of the insert portion, and the ring receiver is formed on the pipe attachment opening. As a result, upon assembling the winding stem pipe and its surroundings can be assembled while the friction ring is being retained on the insert portion, and whether the friction ring is attached or not can be visually checked with ease at the time of assembly.

According to a preferred example of the present invention, a ring-shaped waterproof packing is provided closer to the crown head than a screw-engagement portion between the female screw of the case band and the fist male screw is positioned. Consequently, the exposure of the friction ring to ozone or moisture can be prevented by the waterproof packing and thus the friction ring need not offer a waterproofing effect.

According to a preferred example of the present invention, the friction ring has an annular collar at one end, a ring fitting near the case band is provided on the pipe attachment opening which ring fitting includes an annular step and a small-diameter hole formed in succession from the step, a ring fitting near the pipe is provided on the insert portion which ring fitting includes a circular periphery wall and another annular step formed in succession from the periphery wall, and a ring-shaped portion of the friction ring other than the collar is interposed between the small-diameter hole and the periphery wall and the collar is interposed between both of the annular steps, so that the friction ring is interposed between both of the ring fittings. In this structure, the contact area for acquiring friction is increased in the amount corresponding to the collar of the friction ring and thus waterproofing effect around the collar can be obtained.

According to a preferred example of the present invention, the ring receiver and the friction ring are disposed closer to the crown head than a screw-engagement portion between the female screw of the case band and the first male screw to also function as a waterproof packing. Thus, a special-purpose waterproof packing for waterproofing the boundary between the winding stem pipe and the pipe attachment opening is not particularly required.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the present invention is hereinafter described with reference to FIGS. 1 through 3.

Figure 1:
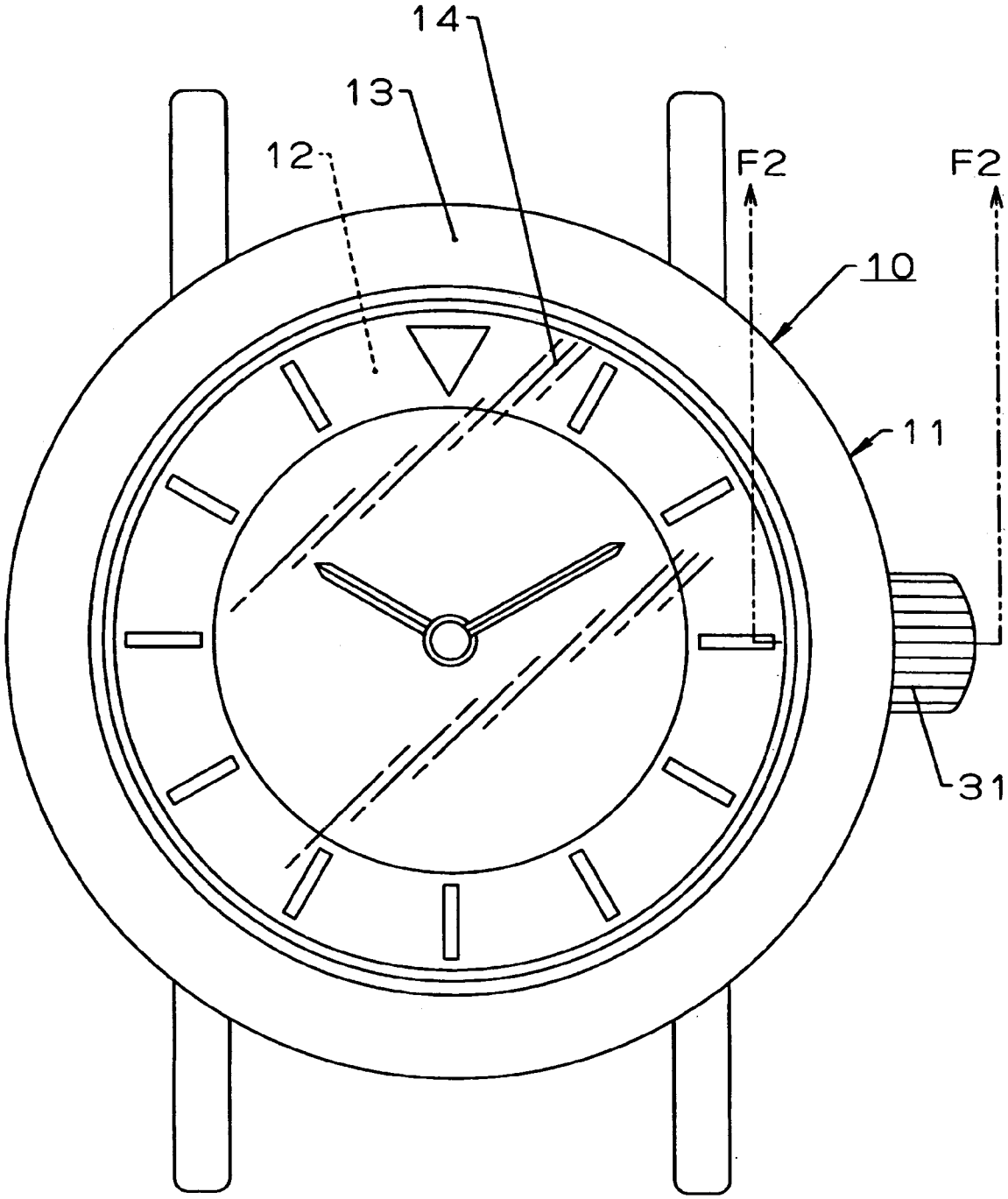
FIG. 1 is a front view illustrating a portable timepiece of a first embodiment according to the present invention.

A reference numeral 10 in FIG. 1 denotes a wrist portable timepiece as an example of a portable timepiece, and the wrist portable timepiece 10 contains a dial 12, a portable timepiece movement (not shown) and other components within a portable timepiece casing assembly 11. The portable timepiece movement may be any type selected from a movement powered by a miniature battery or a mainspring, a movement of automatically winding type, a movement for a digital portable timepiece which displays time and others on the dial 12 in digital form by means of a quartz oscillation module, or a combination type including both movements for a digital portable timepiece and for other portable timepieces.

Figure 2:
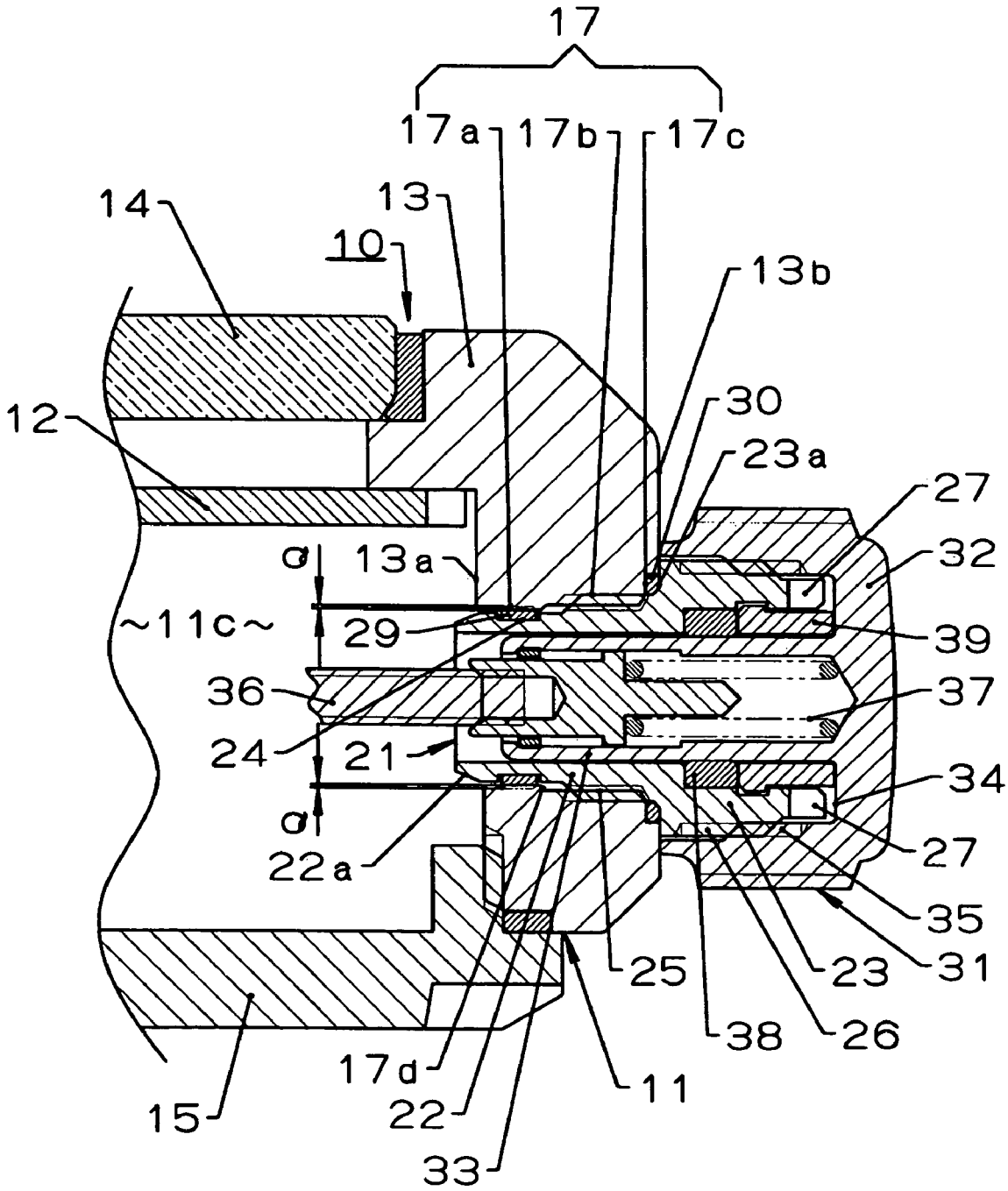
FIG. 2 is a sectional view showing winding stem pipe and its surroundings taken along a line F2—F2 in FIG. 1.

As illustrated in FIG. 2, the portable timepiece casing assembly 11 includes a cover glass 14 which is liquid-tightly fitted to one side of an annular metal case band 13 in a thickness direction thereof, and a case back made from metal or other material which is liquid-tightly screwed into the other side of the case band 13 in the opposite thickness direction thereof. The dial 12 can be viewed through the cover glass 14. The case back 15 is removable.

As shown in FIG. 2, the case band 13 has a pipe attachment opening 17 as a stepped hole having a circular cross section at a part of the case band. The pipe attachment opening 17 penetrates through the case band 13 in a radial direction thereof. One end of the pipe attachment opening 17 is open to a case band inner space 11*c* of the case band 13, i.e., the interior of the case band, and the other end of the pipe attachment opening 17 is open to the outside of the case band, i.e., the outside of the portable timepiece casing assembly 11.

The pipe attachment hole 17 has a ring receiver 17*a*, a female screw 17*b* and a packing container 17*c*. The ring receiver 17*a* is, for example, a portion having the smallest hole diameter of the pipe attachment opening 17 and open to a case band inner surface 13*a* of the case band 13. The case band inner surface 13*a* faces to the case band inner space 11*c*. The female screw 17*b* is defined close to a case band outer surface 13*b* of the case band 13 with an annular step 17*d* formed between the female screw 17*b* and the ring receiver 17*a*. The inside diameter of the female screw 17*b* is larger than the diameter of the ring receiver 17*a*. The packing container 17*c* is formed close to a crown head 32 described later formed in succession from the female screw 17*b* to be open to the case band outer surface 13*b* of the case band 13. The diameter of the packing container 17*c* is larger than the major diameter of the female screw 17*b*. In this hole structure of the pipe attachment opening 17, the female screw 17*b* is interposed between the ring receiver 17*a* and the packing container 17*c*.

Figure 3A:
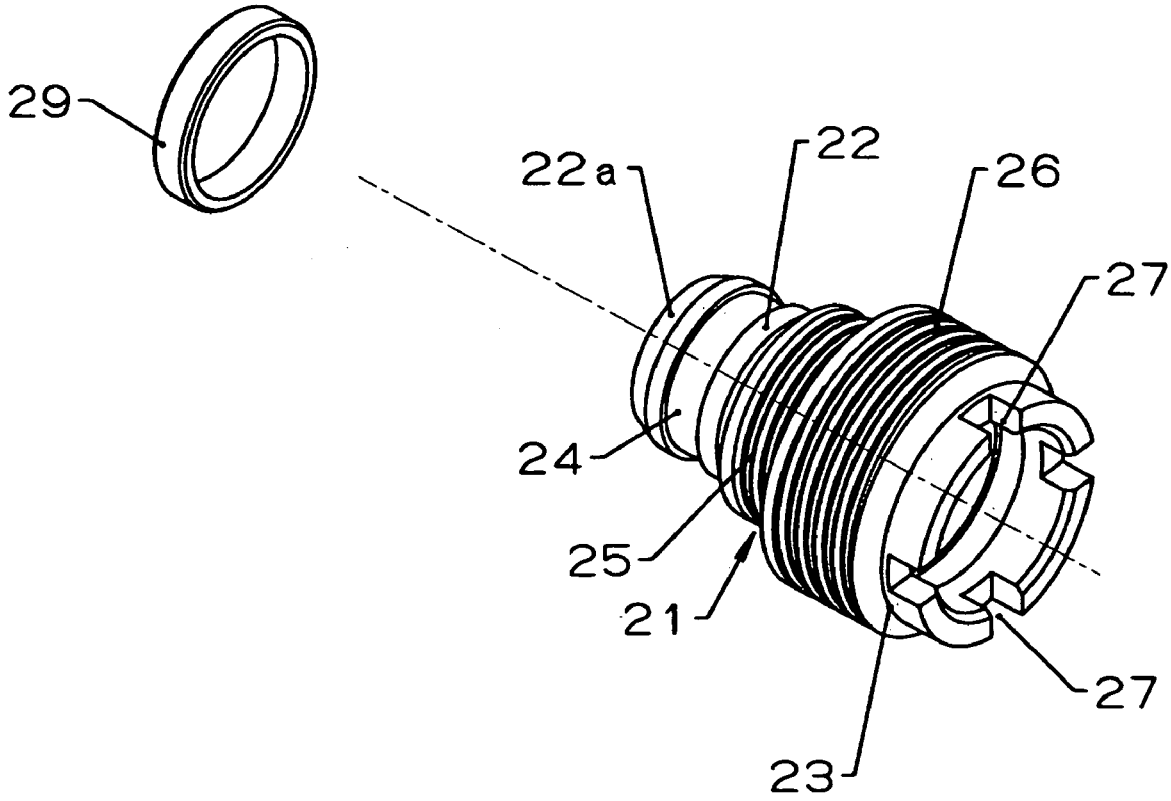
FIG. 3A is a perspective view illustrating a condition in which the winding stem pipe included in the portable time piece in FIG. 1 and a friction ring supported on the winding stem pipe are separated from each other.
Figure 3B:
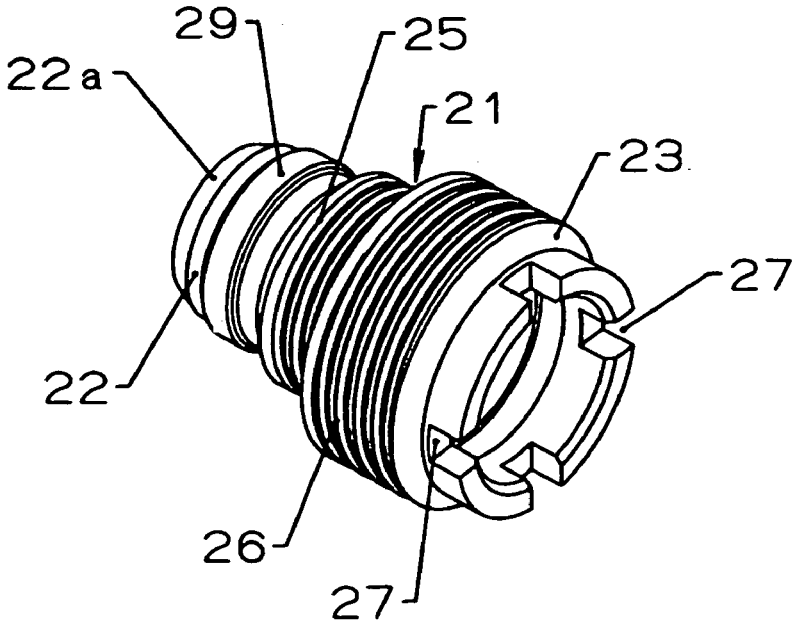
FIG. 3B is a perspective view illustrating a condition in which the friction ring is supported on the winding stem pipe included in the portable timepiece in FIG. 1.

A winding stem pipe 21 is removably inserted into the pipe attachment opening 17 of the case band 13 of the portable timepiece casing assembly 11 from the outside of the case band. The winding stem pipe 21 is formed from metal, such as stainless steel, and has an inner insert portion 22 and a pipe end or outer portion 23 that projects out of the case band 13 as illustrated in FIGS. 2, 3A and 3B.

The area closer to the tip of the insert portion 22 is a portion having a slightly smaller diameter than the hole diameter of the ring receiver 17*a* so as to be inserted into the ring receiver 17*a*. An annular groove 24 is defined on the outer periphery of the area closer to the tip of the insert portion 22, and a tapered region 22*a* is provided on the insert portion 22 between the tip of the insert portion 22 and the annular groove 24 thereof so as to easily insert the insert portion 22 into the ring receiver 17*a*. A first male screw 25 is formed on the insert portion 22 at a position closer to the root thereof, i.e. to the pipe end 23. The first male screw 25 is threaded into the female screw 17*b*. Thus, the winding stem pipe 21 is inserted into the case band 13 by screwing the insert portion 22 of the winding stem pipe 21 into the pipe attachment opening 17.

The pipe end 23 has a larger diameter than that of the insert portion 22 and is exposed outside of the case band 13. The end surface 23*a* of the pipe end 23 close to the insert portion 22 contacts the case band outer surface 13*b*. The end surface 23*a* is so sized as to close the packing container 17*c*. The end surface 23*a* regulates the screwing depth (insertion depth) of the winding stem pipe 21 with respect to the case band 13 by impinging on the case band outer surface 13*b*.

A second male screw 26 is provided on the outer periphery of the pipe end 23. The other end of the pipe end 23, i.e. the opposite side of the pipe end 23 with the second male screw 26 interposed between that side and the insert portion 22 is smaller in diameter than the second male screw 26, and is provided with a plurality of cutout grooves 27 which a not-shown tool engages with and disengages from. The winding stem pipe 21 can be rotated by means of the tool engaging with the cutout grooves 27. This rotation allows the winding stem pipe 21 to be screwed into the pipe attachment opening 17 through the screw-engagement between the female screw 17*b* and the first male screw 25, and to be taken out from the pipe attachment opening 17 by releasing the screw-engagement.

A soft and resilient friction ring 29 is fitted to the annular groove 24 of the insert portion 22. The friction ring 29 thus supported provides winding tightness by its resilient force for shrinking its diameter. Thus, the inner periphery of the friction ring 29 tightly contacts with the annular groove 24. The outside diameter of the friction ring 29 is larger than the hole diameter of the ring receiver 17*a* such that the outer periphery of the friction ring 29 is resiliently brought into tight contact with the ring receiver 17*a*.

The friction ring 29 has a width larger than its radial thickness and a rectangular cross section. The width of the friction ring 29 may be 0.5 mm or larger, but preferably it is the largest possible width for a suitable balance with the respective lengths of the pipe attachment opening 17 and the female screw 17*b* so as to enlarge the friction area as much as possible.

The friction ring 29 is elastically deformable and formed from soft and resilient material which elastically deforms while varying in volume like rubber material so as to frictionally regulate the rotation of the winding stem pipe 21. The friction ring 29 can be appropriately manufactured from an elastic material having stable weatherability to moisutre, ozone or other condition such as synthetic resin like polypropylene, but may be made from natural rubber.

The packing container 17*c* of the case band 13 accommodates a waterproof packing 30. The waterproof packing 30 is formed from elastic rubber in a ring shape.

As described above, the insert portion 22 to which the friction ring 29 is fitted is screwed into the pipe attachment opening 17 from the outside of the case band. By this action, the friction ring 29 is compressed with elastic deformation due to the diameter difference between the friction ring 29 and the ring receiver 17*a*. In this condition, the outer periphery of the friction ring 29 which is interposed between the ring receiver 17*a* and the insert portion 22 is resiliently brought into tight contact with the ring receiver 17*a*. At the final screwing stage of the insert portion 22, the end surface 23*a* of the pipe end 23 presses the waterproof packing 30 in the thickness direction to contact the case band outer surface 13*b*.

In the process of screwing the winding stem pipe 21 into the case band 13 as mentioned, the screw-engagement between the first male screw 25 and the female screw 17*b* proceeds to some extent before the friction ring 29 is forcedly inserted into the ring receiver 17*a*, and subsequent to the insertion of the friction ring 29 the screw-engagement further continues. Thus, the elastic deformation of the friction ring 29 does not adversely affect the proceeding of the screw-engagement between the female screw 17*b* and the male screw 25. The sign Q in FIG. 2 denotes a compression margin (tightening margin) of the friction ring 29. The compression margin Q can be easily controlled by the dimensional accuracy of the insert portion 22, the pipe attachment opening 17 and the friction ring 29.

FIG. 2 shows a condition in which the winding stem pipe 21 is attached to the case band 13. In this condition, the friction ring 29 which tightly contacts the ring receiver 17*a* is disposed close to the case band inner space 11*c*. The screw-engagement portion between the female screw 17*b* and the first male screw 25 which engages therewith is positioned closer to the case band outer surface 13*b* than the friction ring 29 is located. The waterproof packing 30 is disposed still closer to the case band outer surface 13*b* than the screw-engagement portion is positioned.

In this arrangement, the friction ring 29 is separated from the outside of the case band 13 by both of the waterproof packing 30 and the screw-engagement portion, thereby acquiring dual protections from moisture and ozone. Thus, the degradation of the friction ring 29 is effectively prevented even when it is formed from natural rubber, allowing the friction ring 29 to be more durable and maintain predetermined characteristics for long periods of time. Additionally, the material for the friction ring 29 can be selected from a broader range since waterproofing of the friction ring 29 is not particularly required.

These advantages are also offered through a single protection of the screw-engagement portion in the structure not including the waterproof packing 30. However, a portable timepiece having more enhanced waterproofing can be provided when the waterproof packing 30 is added as described above.

As described above, the winding stem pipe 21 is fitted to the case band 13 with the friction ring 29 retained on the outer periphery of the insert portion 22. Thus, the respective actions of fitting the friction ring 29 to the pipe attachment opening 17 and screwing the insert portion 22 need not be carried out separately but can be completed at a time. Also, the friction ring 29 does not accidentally come off, which occurs on handling the friction ring 29 separately. As a result, the attachment of the winding stem pipe 21 to the case band 13 is facilitated. Furthermore, it is visually checked with ease at the time of assembly whether the friction ring 29 is attached or not. Thus, fitting the winding stem pipe 21 to the case band 13 accidentally without the friction ring 29 can be avoided. Additionally, since the annular groove 24 for retaining the friction ring 29 is more easily formed on the outer periphery of the pipe than on the inner periphery of the opening, the manufacturing cost can be reduced.

The inside diameter of the female screw 17*b* is larger than the outside diameter of the friction ring 29. Thus, damage to the outer periphery of the friction ring 29 is avoided which damage may be caused if the outer periphery of the friction ring 29 impinges on the female screw 17*b* in accordance with the screwing action of the winding stem pipe 21 into the case band 13. Consequently, the waterproofing effect at the final waterproof point is easily guaranteed through the tight contact between the friction ring 29 and the ring receiver 17*a* caused by the resiliency of the friction ring 29.

A crown 31 shown in FIGS. 1 and 2 is formed from metal, and includes a crown head 32 and a crown shaft 33 integral with the crown head 32 and extending from the center of the crown head 32 in the axial direction. The crown head 32 has an annular clearance groove 34 for surrounding the root of the crown shaft 33. The clearance grove 34 accommodates the pipe end 23. A female screw 35 formed on the inner periphery of the clearance groove 34 for effecting screw-locking releasably screw-engages with the second male screw 26 of the pipe end 23.

The crown shaft 33 is slidably inserted into the winding stem pipe 21 from the outside of the case band and is rotatable in the winding stem pipe. A winding stem 36 of the portable timepiece movement is connected to the crown shaft 33 from the inside of the case band. A coil spring to which a reference numeral 37 is given in FIG. 2 is contained within the crown shaft 33 for exerting force on the widing stem 36.

An annular waterproof packing made of rubber to which a reference numeral 38 is given in FIG. 2 is accommodated within a concave of the pipe end 23. A pressing ring to which a reference numeral 39 is given is engagedly fitted to the root of the crown shaft 33. The pressing ring 39 elastically deforms the waterproof packing 38 into a compressed condition in accordance with the action of screwing the crown head 32 such that the crown head 32 caps the pipe end 23. Thus, the boundary between the inner periphery of the winding stem pipe 21 and the outer periphery of the crown shaft 33 is waterproofed.

For operating the winding stem 36 of the wrist portable timepiece 10 having the aforementioned structure, the crown 31 is first rotated in a loosening direction so as to release the female screw 35 of the crown 31 from the second male screw 26 of the winding stem pipe 21. Subsequently, the crown 31 is pulled out to a predetermined position keeping the above condition. The crown 31 is then rotated at that position to control the portable timepiece movement for time or other adjustment.

After the adjustment, the crown 31 is pushed back and then the female screw 35 is brought into screw-engagement with the second male screw 26 such that the crown head 32 caps the pipe end 23. This arrangement allows the crown 31 to maintain the condition that the crown head 32 caps the pipe end 23, and offers a screw-locking effect in which the crown 31 is not accidentally rotated while the wrist portable timepiece 10 is being carried.

In operating the winding stem, a force for rotating the winding stem pipe 21 is exerted thereon in accordance with the actions of fitting and releasing the female screw 35 of the crown 31 to and from the second male screw 26. However, the friction ring 29 interposed between the insert portion 22 of the winding stem pipe 21 and the ring receiver 17*a* of the pipe attachment opening 17 is brought into tight contact with those regions by the resiliency of the friction ring 29 while exerting a predetermined amount of frictional force. This frictional force provides sufficient resistance to the accidental rotation of the winding stem pipe 21. Thus, it is not required to fix the winding stem pipe 21 to the case band 13 with an adhesive to avoid the accidental rotation of the winding stem pipe 21.

Accordingly, for the maintenance of the wrist portable timepiece 10, the crown 31 is first removed in a known manner and the winding stem pipe 21 is then rotated in the loosening direction as described above. Subsequently, the engagement between the first male screw 25 of the winding stem pipe 21 and the female screw 17*b* of the case band 13 is released. Finally, the winding stem pipe 21 is taken out from the pipe attachment opening 17.

Therefore, the winding stem pipe 21 can be individually replaced when it needs to be replaced. Thus, the cost for replacing the winding stem pipe 21 borne by a customer who requests repair thereof can be lowered, since not the entire components of the portable timepiece casing assembly 11 including the case band 13 but only a related part is needed to be replaced.

Additionally, in cleaning the case band 13 by polishing the case band outer surface 13*b* with buff or by other method at the maintenance, the winding stem pipe 21 can be removed so as to be put away from the surface to be polished, whether the winding stem pipe 21 is replaced or not. Thus, easy and complete polishing of the case band outer surface 13*b* can be attained.

Explained below are a second through a fifth embodiments according to the present invention. These embodiments basically have similar aspects to those in the first embodiment, and therefore only the points differing from the descriptions in the first embodiment are mentioned while omitting the similar descriptions on the similar components to which the identical reference numerals as included in the first embodiment are given.

Figure 4:
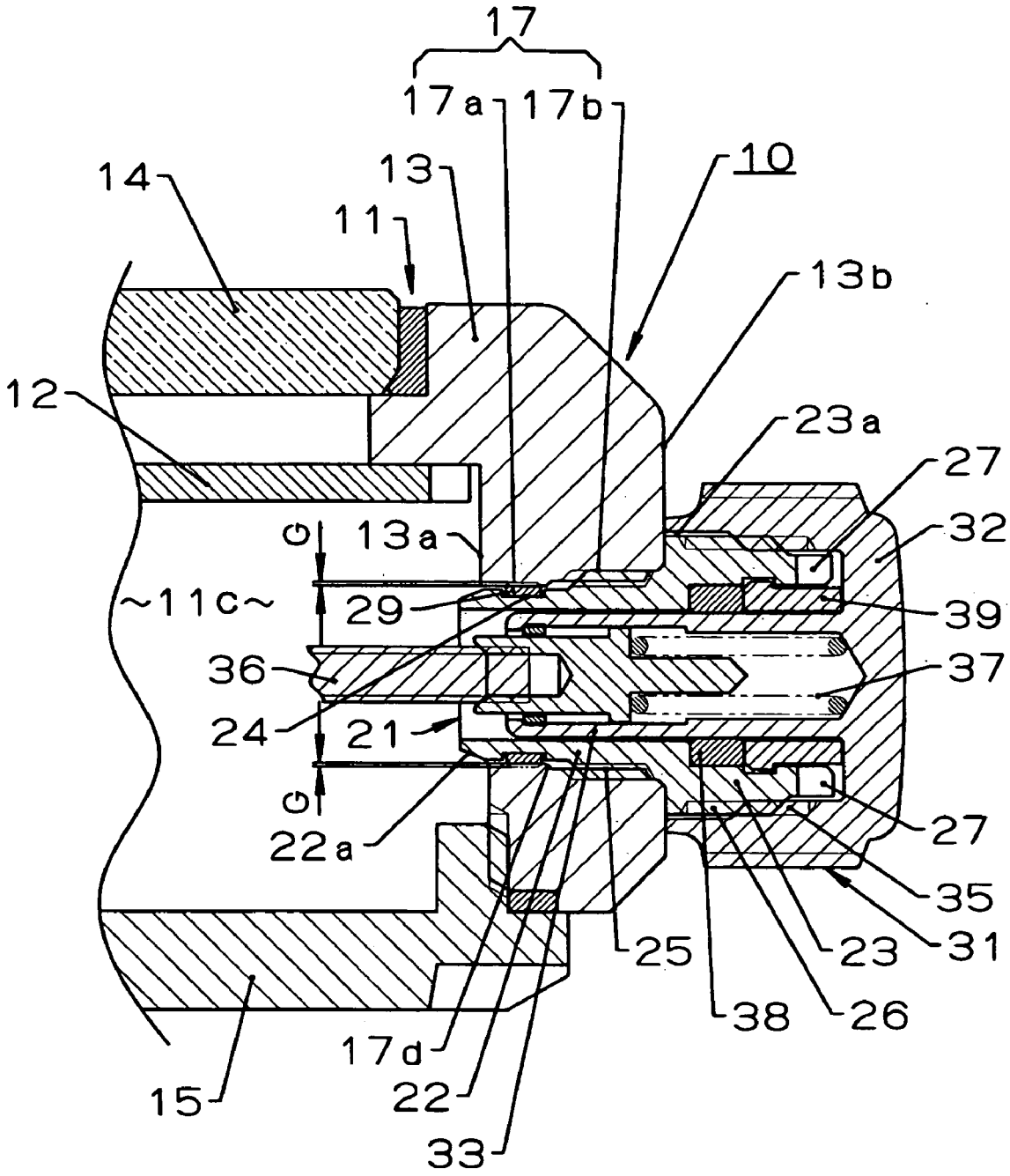
FIG. 4 is a sectional view showing a winding stem pipe and its surroundings of a portable timepiece in a second embodiment according to the present invention.

FIG. 4 illustrates the second embodiment of the invention. This embodiment is identical to the first embodiment including not-shown components except that the waterproof packing adopted in the first embodiment is not contained.

According to the structure of the wrist portable timepiece 10 in the second embodiment, the accidental rotation of the winding stem pipe 21 which may be caused by the revolving operation of the crown 31 is also prevented by the friction ring 29 interposed between the insert portion 22 of the winding pipe 21 and the pipe attachment opening 17 having the ring receiver 17*a* without the necessity for bonding the winding stem pipe 21 to the case band 13 with an adhesive for the prevention of the rotation of the winding stem pipe 21. Thus, the object of the present invention can be achieved. In addition, the number of the components to be used can be decreased, and the desirable wrist portable timepiece 10 which need not be highly waterproofed but only requires daily living waterproof can be provided.

Figure 5:
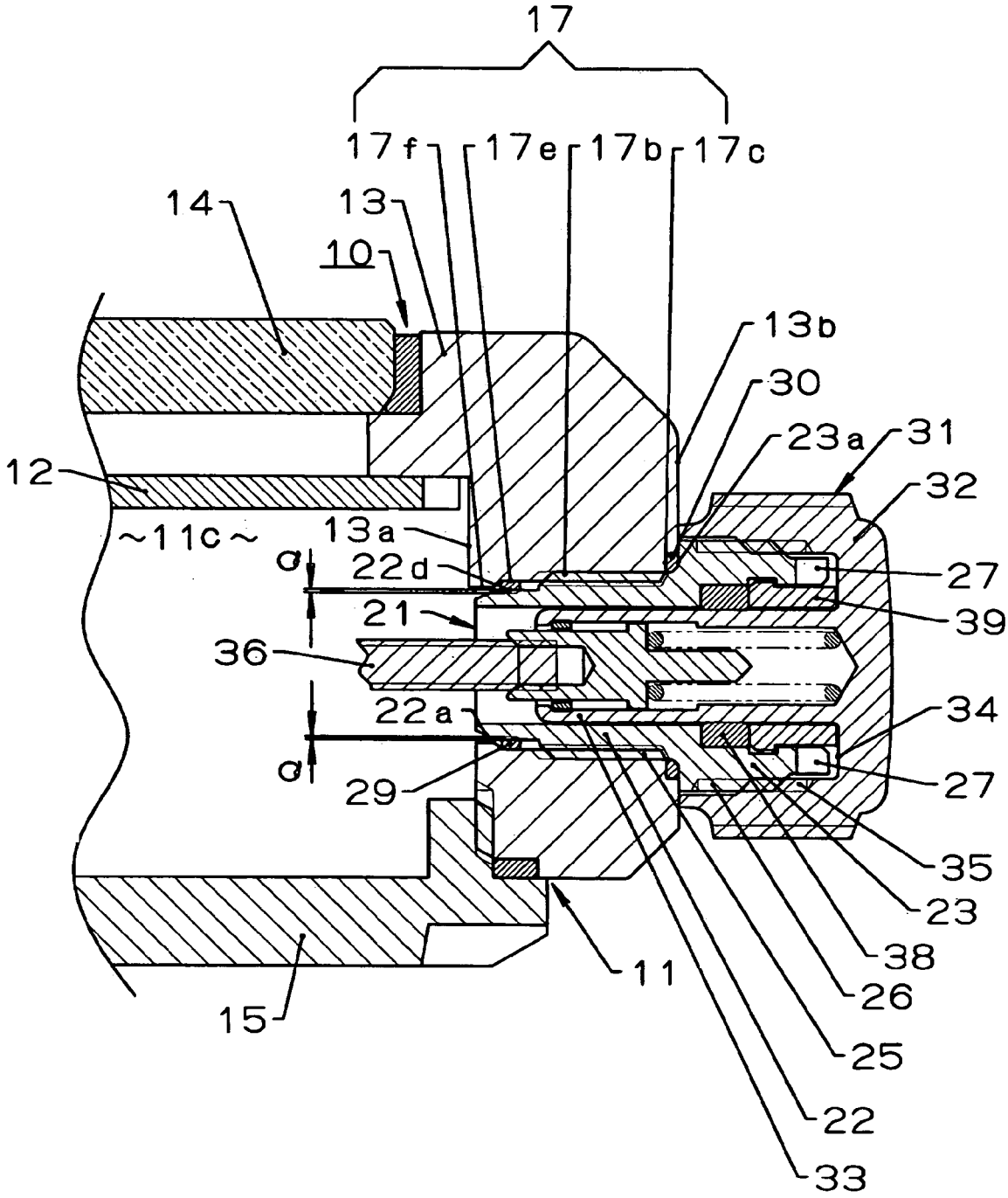
FIG. 5 is a sectional view showing a winding stem pipe and its surroundings of a portable timepiece in a third embodiment according to the present invention.

FIG. 5 illustrates the third embodiment of the invention. According to this embodiment, a ring attachment hole 17*e* and an annular step 17*f* are formed on the pipe attachment opening 17 close to the case band inner space 11*c* in lieu of the ring receiver 17*a* of the first embodiment. The hole diameter of the ring attachment hole 17*e* is equal to or smaller than the inside diameter of the female screw 17*b*. The outer periphery of the friction ring 29 is supported on the ring attachment hole 17*e*. The annular step 17*f* is formed in succession from the side of the ring attachment hole 17*e* closer to the case band inner space 11*c*. The hole diameter of the annular step 17*f* is smaller than that of the ring attachment hole 17*e*. The annular step 17*f* is provided to function as a stopper wall for preventing the friction ring 29 from being pushed into the case band inner space 11*c*. The outer periphery of the insert portion 22 between the tip thereof and the first male screw 25 is a ring receiver 22*d* with which the inner periphery of the friction ring 29 tightly contacts due to its elasticity.

In the third embodiment where the friction ring 29 is fitted to the pipe attachment opening 17 and also the ring receiver 22*d* is formed on the insert portion 22, the friction ring 29 elastically deforms into a compressed condition and the inner periphery thereof tightly contacts the ring receiver 22*d* when the insert portion 22 is screwed into the ring attachment opening 17. All the aspects in the third embodiment including structures not shown in FIG. 3 except for the points described above are similar to those in the first embodiment.

Thus, in the wrist portable timepiece 10 of the third embodiment, the accidental rotation of the winding stem pipe 21 which may be caused by the rotational operation of the crown 31 is also prevented by means of the friction ring 29 interposed between the pipe attachment opening 17 and the insert portion 22 having the ring receiver 22*d* of the winding stem pipe 21. Accordingly, it is unnecessary to bond the winding stem pipe 21 to the case band 13 with an adhesive for the prevention of the rotation of the winding stem pipe 21, and the object of the present invention can be thus achieved.

Figure 6:
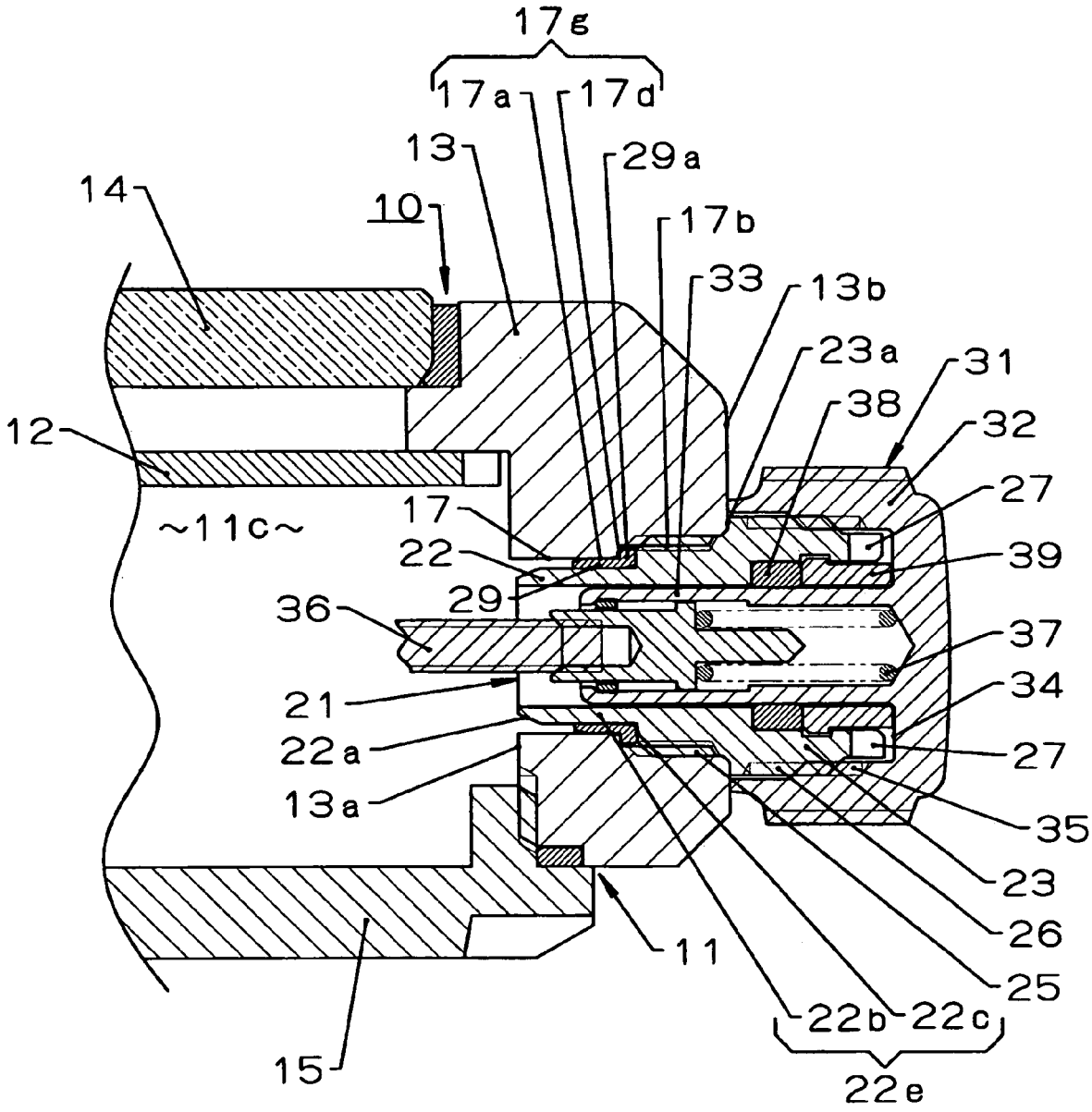
FIG. 6 is a sectional view showing a winding stem pipe and its surroundings of a portable timepiece in a fourth embodiment according to the present invention.

FIG. 6 illustrates the fourth embodiment according to the present invention. In this embodiment, the ring receiver 17*a* and the annular step 17*d* of the first embodiment are formed in succession providing a right angle and constitute a ring fitting 17*g* near the case band. The insert portion 22 is equipped with a ring fitting 22*e* near the pipe. The ring fitting 22*e* near the pipe has a circular periphery 22*b* facing the ring receiver 17*a*, and an annular step 22*c* formed successively from the circular periphery 22*b* while providing a right angle. The annular step 22*c* faces the annular step 17*d*.

The friction ring 29 has an outwardly extending collar 29*a* at one end of the ring-shaped portion of the friction ring 29. The friction ring 29 is interposed between both of the ring fittings 17*g* and 22*e*, where the friction ring 29 elastically deforms into a compressed condition. The friction ring 29 may be supported along the ring fitting 17*g* near the case band in advance, or may be supported on the insert portion 22 along the ring fitting 22*e* near the pipe. Thus, one of the ring fittings 17*g* and 22*e* functions as a ring support, and the other as a ring receiver. Also, in the fourth embodiment the waterproof packing adopted in the first embodiment is not included, which decreases the number of components used. All the aspects in the fourth embodiment including structures not shown in FIG. 6 except for the points described above are similar to those in the first embodiment.

Thus, in the wrist portable timepiece 10 of the fourth embodiment, the accidental rotation of the winding stem pipe 21 which may be caused by the rotational operation of the crown 31 is also prevented by means of the friction ring 29 interposed between the insert portion 22 of the winding stem pipe 21 and the pipe attachment opening 17. Accordingly, it is unnecessary to bond the winding stem pipe 21 to the case band 13 with an adhesive for the prevention of the rotation of the winding stem pipe 21, and the object of the present invention can be thus achieved.

Furthermore, the collar 29*a* of the friction ring 29 can be sandwiched between the steps 17*d* and 22*c* of the ring fittings 17*g* and 22*e*, respectively, in the shaft direction of the winding stem pipe 21 when the winding stem pipe 21 is screwed. Thus, the area of the friction ring 29 contacting with the insert portion 22 and the pipe attachment opening 17 is increased by the amount of the collar 29*a*. This enhances the effect for preventing the rotation of the winding stem pipe 21, and improves waterproofing around the collar 29*a*. Therefore, the desirable wrist portable timepiece 10 which need not be highly waterproofed but only requires daily living waterproof can be provided.

Figure 7:
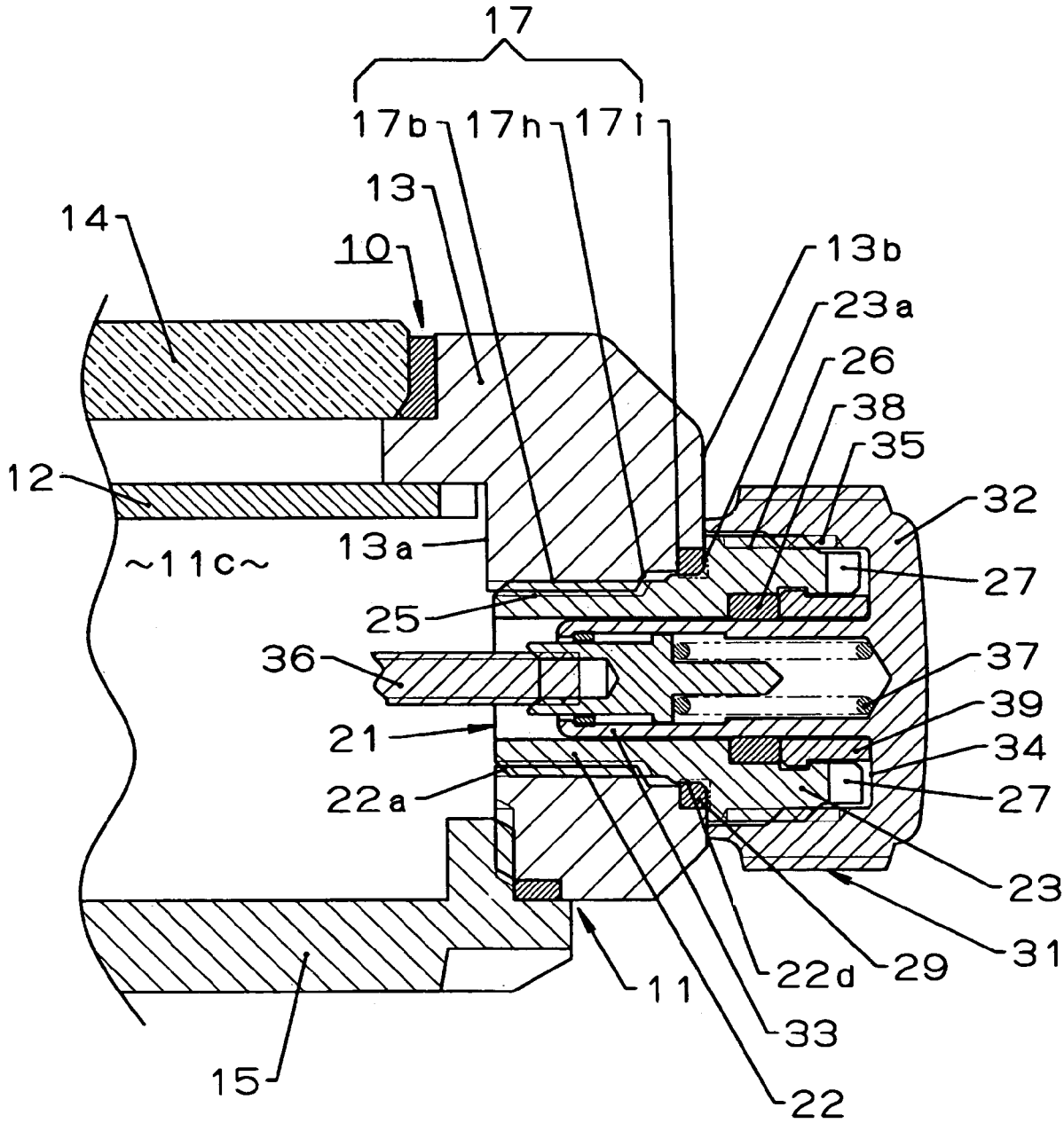
FIG. 7 is a sectional view showing a winding stem pipe and its surroundings of a portable timepiece in a fifth embodiment according to the present invention.

FIG. 7 illustrates the fifth embodiment according to the present invention. In this embodiment, the pipe attachment opening 17 has the female screw 17*b* disposed close to the case band inner space 11*c*, an annular step 17*h* formed successively from the side of the female screw 17*b* closer to the case band outer surface 13*b*, and an annular ring container 17*i* formed successively from the step 17*h* and open to the case band outer surface 13*b*. The diameter of the ring container 17*i* is larger than the major diameter of the female screw 17*b*. The ring container 17*i* accommodates the friction ring 29 which also functions as a waterproof packing.

The outer periphery of the root of the insert portion 22 is defined as the ring receiver 22*d*. The first male screw 25 is formed on the outer periphery of the insert portion 22 between the ring receiver 22*d* and the tip of the insert portion 22. The diameter of the first male screw 25 is smaller than that of the ring receiver 22*d*. When the insert portion 22 of the winding stem pipe 21 is screwed into the pipe attachment opening 17, the end surface 23*a* of the pipe end 23 elastically deforms the friction ring 29 by compression at the final stage of the screwing action. As a result, the inner periphery of the friction ring 29 tightly contacts the ring receiver 22*d* of the insert portion 22 due to the resiliency of the friction ring 29. All the aspects in the fifth embodiment including structures not shown in FIG. 7 except for the points described above are similar to those in the first embodiment.

Thus, in the wrist portable timepiece 10 of the fifth embodiment, the accidental rotation of the winding stem pipe 21 which may be caused by the rotational operation of the crown 31 is also prevented by means of the friction ring 29 interposed between the insert portion 22 of the winding stem pipe 21 and the pipe attachment opening 17. Accordingly, it is unnecessary to bond the winding stem pipe 21 to the case band 13 with an adhesive for the prevention of the rotation of the winding stem pipe 21, and the object of the present invention can be thus achieved. Moreover, since the friction ring 29 also functions as a waterproof packing, the number of the components to be used can be decreased and the desirable wrist portable timepiece 10 which need not be highly waterproofed but only requires daily living waterproof can be provided.

Additionally, the present invention is especially applicable to a high-pressure waterproofed diver's portable timepiece, and also can be adopted in a pocket portable timepiece or other portable timepieces.

In a portable timepiece according to the present invention which comprises a crown which does not accidentally rotate by means of a screw-locking structure, a friction ring supported on one of a pipe attachment opening of a case band and an insert portion of a winding stem pipe screwed into the pipe attachment opening is resiliently brought into tight contact with a ring receiver formed on the other of the pipe attachment opening and the insert portion. As a result, the accidental rotation of the winding stem pipe which may be caused when operating the crown or by other action is prevented without bonding the winding stem pipe to the case band with an adhesive. Thus, such a portable timepiece is provided in which the maintenance around the winding stem pipe is facilitated due to the detachability of the winding stem pipe from the case band.

According to a structure of the invention in which a ring receiver and a friction ring are disposed closer to a case band inner space of a case band than a screw-engagement portion between a female screw of the case band and a first male screw of a winding stem pipe which engages therewith is positioned, the degradation of the friction ring is reduced. Thus, a portable timepiece including a friction ring with enhanced durability can be provided.

According to a structure of the invention in which an inner periphery of a friction ring is engagedly supported on an annular groove provided on an insert potion and a ring receiver is formed on a pipe attachment opening, such a portable timepiece which is easily assembled and in which whether the friction ring is attached or not is visually checked with ease at the time of assembly can be provided.

According to a structure of the invention in which a ring-like shaped waterproof packing is equipped closer to a crown head than a screw-engagement portion between a female screw of a case band and a first male screw of a winding stem pipe which engaged therewith is positioned, the degradation of a friction ring is reduced. Thus, a portable timepiece including the friction ring having enhanced durability can be provided.

According to a structure of the invention in which: a friction ring has an annular collar at one side, and a pipe attachment opening has a ring fitting near a case band which ring fitting has an annular step and a small-diameter hole formed in succession from the step; an insert portion has another ring fitting near a pipe which ring fitting has a circular periphery wall and another annular step formed in succession from the periphery wall; and a ring-shaped portion of the friction ring other than the collar is interposed between the small-diameter hole and the periphery wall and the collar is interposed between both of the annular steps, so that the friction ring is interposed between both of the ring fittings, such a portable timepiece can be provided in which the effect of preventing the rotation of a winding stem pipe is enhanced and the area around the collar of the friction ring is also waterproofed.

According to a structure of the invention in which a ring receiver and a friction ring are disposed closer to a crown head than a screw-engagement portion between a female screw of a case band and a first male screw is positioned so as to also function as a waterproof packing, such a portable timepiece can be provided which does not particularly require specialized waterproof packing for waterproofing a boundary between a winding stem pipe and a pipe attachment opening.

What is claimed is:

1. A portable timepiece comprising:

a case band provided with a pipe attachment opening having a female screw;

a winding stem pipe including an insert portion provided with a first male screw releasably screwed into the female screw and a pipe end provided with a second male screw and disposed outside of the case band, the insert portion being screwed into pipe attachment opening to be fitted to the case band;

a rotatable crown rotatable to adjust a function of the timepiece and having a crown head provided with a female screw which releasably screw-engages with the second male screw to be fitted to the winding stem pipe; and a friction ring which is supported on one of the pipe attachment opening and the insert portion and which is soft and resilient so as to be resiliently brought into tight contact with a ring receiver formed on the other of the pipe attachment opening and the insert portion to frictionally prevent rotation of the winding stem pipe when the crown is rotated.

2. A portable timepiece as set forth in claim 1; wherein the ring receiver and the friction ring are disposed closer to a case band inner space than a screw-engagement portion between the female screw of said the case band and said the first male screw is located.

3. A portable timepiece as set forth in claim 2; wherein the friction ring is supported such that an inner periphery of the friction ring engages an annular groove formed on the insert portion, and the ring receiver is provided on the pipe attachment opening.

4. A portable timepiece as set forth in claim 2; wherein a ringshaped waterproof packing is provided closer to the crown head than a screw-engagement portion between the female screw of the case band and the first male screw.

5. A portable timepiece as set forth in claim 2; wherein the friction ring has an annular collar at one end, a ring fitting near the case band is provided on the pipe attachment opening and includes an annular step and a small-diameter hole, a ring fitting near the pipe is provided on the insert portion and includes a circular periphery wall and another annular step and a ring-shaped portion of the friction ring other than the collar is interposed between the small-diameter hole and the periphery wall and the collar is interposed between both of the annular steps, so that the friction ring is interposed between both of the ring fittings.

6. A portable timepiece as set forth in claim 1; wherein the friction ring is supported such that an inner periphery of the friction ring engages an annular groove formed on the insert portion, and the ring receiver is provided on the pipe attachment opening.

7. A portable timepiece as set forth in claim 6; wherein a ring-shaped waterproof packing is provided closer to the crown head than a screw-engagement portion between the female screw of the case band and the first male screw.

8. A portable timepiece as set forth in claim 1; wherein a ring-shaped waterproof packing is provided closer to the crown head than a screw-engagement portion between the female screw of the case band and the first male screw.

9. A portable timepiece as set forth in claim 1; wherein the friction ring has an annular collar at one end, a ring fitting near the case band is provided on the pipe attachment opening and includes an annular step and a small-diameter hole, a ring fitting near the pipe is provided on the insert portion and includes a circular periphery wall and another annular step, and a ring-shaped portion of the friction ring other than the collar is interposed between the small-diameter hole and the periphery wall and the collar is interposed between both of the annular steps, so that the friction ring is interposed between both of the ring fittings.

10. A portable timepiece as set forth in claim 1; wherein the ring receiver and the friction ring are disposed closer to the crown head than a screw-engagement portion between the female screw of the case band and the first male screw to also function as a waterproof packing.

11. A portable timepiece comprising: a case band having a pipe attachment opening extending therethrough, the pipe attachment opening having a female screw; a winding stem pipe having an insert portion which is inserted into the pipe attachment opening and which has a first male screw removably screwed into the female screw and having an exterior portion which is disposed outside of the case band and which has a second male screw; a rotatable crown rotatable to adjust a function of the timepiece and having a crown shaft slidably extending into and rotatable in the winding stem pipe and having a female screw removably screwed onto the second male screw to screw-lock the crown to the case band; and an elastically deformable friction ring supported on one of the pipe attachment opening and the insert portion and being elastically deformed into contact with a ring receiver on the other of the pipe attachment opening and the insert portion during insertion of the insert portion into the pipe attachment opening to frictionally prevent rotation of the winding stem pipe when the crown is rotated.

12. A portable timepiece according to claim 11; wherein the friction ring and the ring receiver are disposed closer to the interior of the case band than a screw-engagement portion of the female screw of the pipe attachment opening and the first male screw.

13. A portable timepiece according to claim 12; wherein the friction ring is supported on the insert portion and is disposed in an annular groove formed on the insert portion.

14. A portable timepiece according to claim 13; further including a ring-shaped waterproof packing encircling the winding stem pipe and interposed between the case band and the winding stem pipe.

15. A portable timepiece according to claim 14; wherein the waterproof packing is disposed closer to the outside of the case band than a screw-engagement portion of the female screw of the pipe attachment opening and the first male screw.

16. A portable timepiece according to claim 11; further including a ring-shaped waterproof packing encircling the winding stem pipe and interposed between the case band and the winding stem pipe.

17. A portable timepiece according to claim 16; wherein the waterproof packing is disposed closer to the outside of the case band than a screw-engagement portion of the female screw of the pipe attachment opening and the first male screw.

18. A portable timepiece according to claim 11; wherein the friction ring has an outwardly extending annular collar and is disposed between opposed stepped portions of the pipe attachment opening and the insert portion.

19. A portable timepiece according to claim 18; wherein the friction ring is disposed at an axial mid-portion of the pipe attachment opening.

20. A portable timepiece according to claim 11; wherein the friction ring is disposed at an axial mid-portion of the pipe attachment opening.

* * * * *